United States Patent [19]

Owens

[11] Patent Number: 4,934,692

[45] Date of Patent: Jun. 19, 1990

[54] EXERCISE APPARATUS PROVIDING RESISTANCE VARIABLE DURING OPERATION

[75] Inventor: Steve Owens, Portland, Oreg.

[73] Assignee: Robert M. Greening, Jr., Portland, Oreg.

[21] Appl. No.: 857,718

[22] Filed: Apr. 29, 1986

[51] Int. Cl.[5] ..... A63B 21/00

[52] U.S. Cl. ..... 272/73

[58] Field of Search ..... 272/73, DIG. 5, DIG. 6, 272/129, 69; 73/379; 128/25 R, 26

[56] References Cited

U.S. PATENT DOCUMENTS

| | | | |
|---|---|---|---|
| 2,783,044 | 2/1957 | Sbara | 272/73 |
| 3,936,047 | 2/1976 | Brandt et al. | 73/379 X |
| 4,244,021 | 1/1981 | Chiles, III | 272/DIG. 6 X |
| 4,408,613 | 10/1983 | Relyea | 272/DIG. 5 X |
| 4,572,501 | 2/1986 | Dorham et al. | 272/73 |

*Primary Examiner*—Richard J. Apley
*Assistant Examiner*—H. Flaxman
*Attorney, Agent, or Firm*—Klarquist, Sparkman, Campbell, Leigh & Whinston

[57] ABSTRACT

An exercise device including a pedal crank and a hand crank separately drivingly connected to a flywheel provided with a braking mechanism remotely controllable to vary the amount of braking, in response to operation of switches located on the hand crank in a location making removal of the hand from the hand crank unnecessary to operation of the switches. The switches also control selection of various displays of information concerning the exercise being performed.

16 Claims, 1 Drawing Sheet

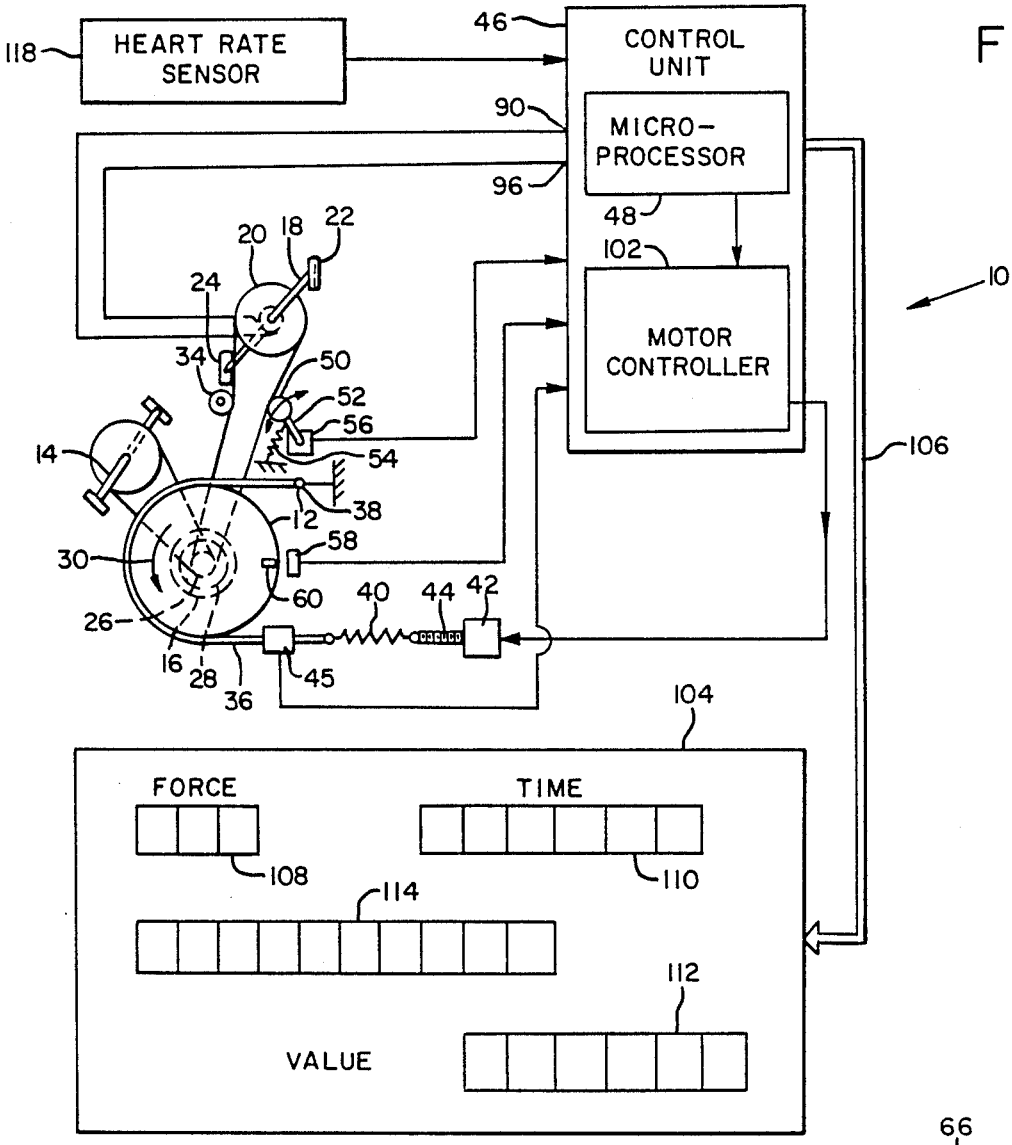
FIG. 1
FIG. 3
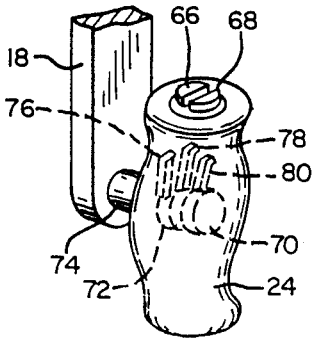
FIG. 2
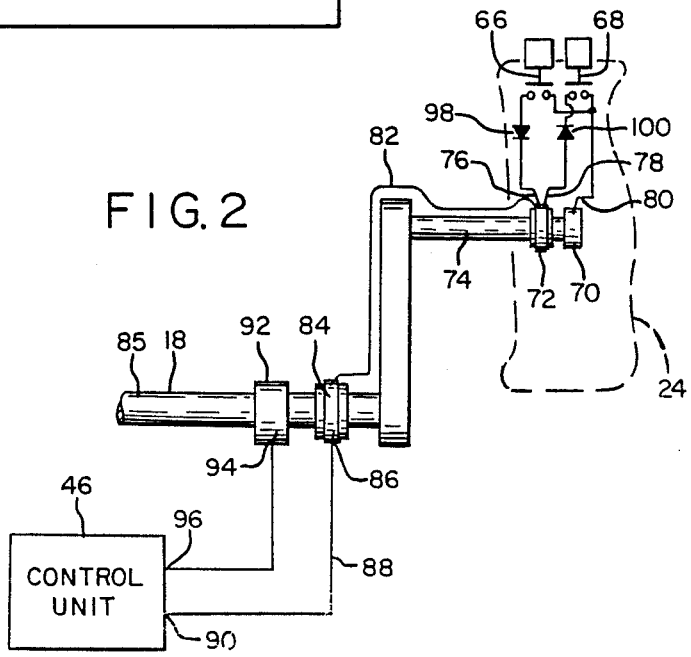

EXERCISE APPARATUS PROVIDING RESISTANCE VARIABLE DURING OPERATION

BACKGROUND OF THE INVENTION

The present invention relates to exercise devices, and particularly to a bicycle-type exercise device including provisions for changing the amount of resistance to operation of the device during the course of use, and which includes provision for displaying the amount of resistance and the amount of exercise performed.

In performing exercise in order to improve body fitness, and particularly in order to improve aerobic conditioning of the body, it is desirable to exercise as many major muscle groups of the body as possible simultaneously. Exercise devices including pedals connected to drive loads such as flywheels equipped with brakes provide a significant amount of leg and lower body trunk exercise. The inclusion of hand cranks adds to the amount of aerobic conditioning which can be achieved using such exercise devices. Some exercise devices previously available have included both pedal cranks and hand cranks, as shown in Samuelson, U.S. Pat. No. 1,386,206, Odom, U.S. Pat. No. 3,216,722, Zent, U.S. Pat. No. 4,071,235, Proprotnik, U.S. Pat. No. 4,222,376, and Figueroa U.S. Pat. No. 4,423,863. Nies U.S. Pat. Nos. 3,572,699 and 3,745,990 disclose such a device including a force-sensing transducer associated with each crank to evaluate the effort used to drive the apparatus.

It is desirable during exercise to be able to adjust the amount of resistance provided by the exercise machine to provide an optimum amount of resistance to efficiently exercise the user's muscles.

Previously, it has been necessary to use the hands to adjust the amount of resistance provided by a bicycle-type exercise device This has been accomplished by manually adjusting a brake mechanism, in many such exercise machines However, if an exercise machine requires use of both hands and feet for its operation, adjusting such a mechanism manually would interrupt the application of force by the hands, or at least by one hand.

Not only is it desirable to be able to exercise the entire body simultaneously, but it is also useful to know the amount of force being developed and the speed at which exercise is being performed, at least on an arbitrary relative scale, so that it is possible for the person using the device to repeat a workout schedule of various times at various levels of effort on, for example, a daily basis. Such knowledge is also helpful to evaluate progress toward better fitness and endurance. It is therefore desirable to have a way to display selectively indications of data such as the amount of exercise performed, the speed at which an exercise device is operated, and the amount of resistance to operation which is presented by the exercise apparatus.

Gause et al., U.S. Pat. No. 3,744,480, discloses an ergometer including a display panel which includes appropriate meters to enable the operator to observe his performance and control the amount of work he must do in exercising. The Gause device does not provide, however, for the user to adjust the effort required to operate the machine by hand during the time when it is being operated by hand Flavell, U.S. Pat. No. 3,848,467, discloses an exercise apparatus which is responsive to the user's performance to vary the amount of braking, or power, provided by the apparatus during performance of exercise at a predetermined speed in accordance with a program which must be set into the apparatus in advance. However, there is no provision for the user to change selectively the amount of resistance provided while the exercise apparatus is being operated.

Pfleiderer et al., U.S. Pat. No. 4,060,239, discloses a pedal-operated crank device with a performance display panel. An electric load-adjusting device maintains the load presented to the user at a previously determined value during exercising.

Dutsch, U.S. Pat. No. 4,112,928, is related to the same exercise device disclosed by Pfleiderer et al., and discloses control of the load presented by the exercise device in response to the heart rate of the user.

Shimano, U.S. Pat. No. 4,443,008, discloses a measuring device including a microprocessor, for determining the amount of exercise achieved during operation of a bicycle and for providing information to the bicycle rider so that he can pace his exercising.

Jones, international patent application publication No. WO 82/02668, discloses an exercise apparatus in which the user's performance is measured by a computer and displayed automatically.

None of the prior art of which the applicant is aware, however, provides for exercising both arms and legs simultaneously at controllably variable levels of effort, while also enabling the amount of resistance provided by the exercise device to be regulated selectively without interruption of exercising. What is desired, then, is an exercise device which can be operated by pedal movement, hand movement, or both simultaneously, and which provides an amount of resistance to exercise which can be varied by the user without interruption of the exercise being performed. Additionally, such a device should include provision for displaying various information concerning the exercise being performed, such as the elapsed time, the amount of work which has been performed, the amount of resistance provided by the apparatus, and the speed at which the apparatus is being operated Additionally, it would be desirable to provide displays of information concerning the user's physiological performance, for example the heart rate.

SUMMARY OF THE INVENTION

The present invention provides an exercise apparatus which overcomes the aforementioned shortcomings and disadvantages of the previously-available exercise devices, by providing an exercise apparatus including a pedal crank and a hand crank interconnected with one another and with a load so that the load can be driven optionally by either the pedal crank or the hand crank or by simultaneous effort applied to both the pedal crank and the hand crank. The amount of frictional resistance provided by the apparatus is controllable automatically in response to closure of an electrical control switch or switches located on a handle of the hand crank, so that the amount of resistance can be changed without interruption of the exercise being performed.

In a preferred embodiment of the invention a frame carries a seat on which the user sits. A pedal crank is located conveniently for being operated by the user's legs and feet, and a hand crank is mounted in an appropriate location for simultaneously being turned by hand. A flywheel is mounted rotatably on the frame, and continuous belts or the like connect the cranks and the flywheel, so as to deliver power from the cranks to the flywheel.

A brake, including a brake band extending around the flywheel, is provided to resist rotation of the flywheel. The amount of resistance provided by the brake is controllably variable under the control of a control unit responsive to operation of a pair of switches located on one of the hand crank handles. The switches are located on the hand crank handle in position for being operated by the use of the operator's thumb while he continues to grasp the crank handle and operate the apparatus uninterrupted.

Appropriate sensors are provided to measure the amount of force applied through the belt between the hand crank and the flywheel, to observe the amount of rotation of the flywheel, and to observe the amount of tension applied to the brake band.

A heart rate sensor may optionally be connected with the control unit, in order to provide information to the control unit about the user's physiological response to the exercise being performed.

The control unit includes a microprocessor which processes the information received, generates displays, and provides signals to control the brake mechanism.

A display unit responsive to the control unit displays information about the exercise being performed. Preferably, displays of the amount of elapsed time of the exercise, and the total amount of force required, as a function of the tension applied to the brake, are provided continuously. Other optional displays available in response to operation of switches on the hand crank might include the total amount of work performed, the user's heart rate, the speed at which the apparatus is being driven, the "distance" covered, the instantaneous arm force, and the instantaneous leg force being applied.

In a preferred embodiment of the invention, a pair of normally open, push-button, momentary closure switches are located side-by-side on one of a pair of pivotable handles of the hand crank. The switches are connected, through slip rings located on the central shaft and the eccentric shaft of the crank, to appropriate circuits originating in and terminating at the control unit. The control unit provides an alternating current voltage through a single control circuit through the slip rings on the hand crank, but a respective diode is connected in series with each of the thumb switches. The diodes are connected in opposing polarity so that closing one of the thumb switches provides current in one direction, while closing the other switch provides a current in the opposite direction which is applied through the control unit to control a motor which adjusts the amount of tension provided to the brake band.

It is therefore a principal object of the present invention to provide an improved exercise device which can be used to provide resistance simultaneously to both the legs and the arms of a user and permit the user to change the amount of resistance provided without interruption of the exercise being performed.

It is another object of the present invention to provide an exercise apparatus which provides separate displays of the amount of exercise being performed by arms and legs.

An important feature of the present invention is the provision of one or more thumb-operated switches on a pivotably mounted hand crank to control electrically and automatically the amount of resistance provided by the exercise apparatus without interruption of the exercise being performed.

It is another important feature of the present invention that it provides displays which are optionally selected by use of a switch mounted on a hand crank handle, so that various information can be displayed at the user's option without interruption of the exercise being performed.

It is a principal advantage of the present invention that it permits exercise to be performed uninterrupted at varying rates of performance as desired by the user and with the effort distributed as desired by the user between legs and arms.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a generally schematic and diagrammatic view of an exercise device embodying the present invention.

FIG. 2 is a schematic diagram of a preferred arrangement of switches mounted on a hand crank for controlling the exercise device shown in FIG. 1.

FIG. 3 is a perspective view of a handle portion of a hand crank of the exercise device shown in FIG. 1.

DETAILED DESCRIPTION OF THE INVENTION

Referring now to the drawings, in FIG. 1, an exemplary exercise apparatus 10, shown in simplified form, includes a flywheel 12 rotatably supported by a frame (not shown). A pedal crank 14 is mounted rotatably on the frame and connected drivingly to the flywheel 12 by an endless chain and sprocket arrangement including a unidirectional clutch 16. Preferably, the flywheel is driven at a higher angular velocity than the pedal crank 14, for example, 2-½ times as fast. A rotatably mounted hand crank 18 is fixedly connected to an upper sheave 20. A pair of crank handles 22 and 24, shown simplified in FIG. 1, are pivotally mounted upon the eccentric shafts of the hand crank 18, so that the crank handles 22 and 24 may be grasped firmly by the user of the apparatus 10 while the hand crank 18 is operated to rotate the upper sheave 20. A lower sheave 26 is rotatably mounted coaxially alongside the flywheel 12. A second unidirectional clutch 28 connects the lower sheave 26 drivingly to the flywheel. Both of the unidirectional clutches are arranged so as to drive the flywheel 12 in the direction indicated by the arrow 30. The upper sheave 20 is connected drivingly to the lower sheave 26 by, for example, a flexible endless loop V-belt 32 whose tension is adjusted to be within a required range by an adjustable idler pulley 34.

A brake band 36 is disposed circumferentially around a suitable peripheral surface of the flywheel 12. A first end of the brake band 36 is fixedly anchored as at 38, while the other end of the brake band is connected, through a tension spring 40, to a tension adjuster 42 including a threaded rod 44 and a tension nut (not shown) rotated by a motor included in the tension adjuster 42 to adjust the tension in the spring 40.

A strain gauge 45 is mounted on the brake band 36 and provides an electrically perceptible indication of the amount of tension in that end of the brake band. As will be explained subsequently, the amount of tension in the brake band 36 is useful in determining the amount of frictional resistance to rotation of the flywheel 12 which is being created at any particular time by the brake band 36 riding on the peripheral surface of the flywheel 12.

The electrical signal provided by the strain gauge 45 is conducted to a control unit 46 which includes a digital microprocessor 48 of a suitably programmable type. For example, the Z-80 microprocessor has been found to be suitable for the purpose of this invention.

A force detecting device 56 provides an electrical signal indicative of the amount of force being applied through the v-belt 32 to turn the flywheel 12 against the resistance of its own inertia and the frictional force applied by the brake band 36. The force measuring device 56 may, for example, include an idler pulley 50 carried on a pivot arm 52 biased toward the Y-belt 32 by a tension spring 54 of suitable strength. Application of tension to the V-belt 32 by forward rotation of the hand crank 18 moves the pulley 50 and rotates a shaft on which the pivot arm 52 is mounted, thus adjusting a potentiometer, for example, to provide an electrically observable indication of the force exerted through the hand crank 18.

The rate of rotation of the flywheel 12 may be detected by the use of a non-contact pulse generator 58 such as a Hall effect device electrically connected in the well known manner to provide an electrically observable signal in response to passage of a magnet 60 with each rotation of the flywheel 12. The electrical signal information from the force measuring device 56 and the Hall effect device 58 are provided as inputs at terminals of the control unit 46. Where necessary the signals will be converted to digital form by appropriate analog-to-digital converters and the resulting digital equivalent will be provided to the microprocessor 48.

The actual total frictional resistance being overcome at any time can be calculated with reasonable accuracy by the microprocessor 48, on the basis of the coefficient of friction, the tension detected by the strain gauge 45, and the angular speed of the flywheel 12 as determined using the signals provided by the pulse generator 58.

It will be appreciated that other braking devices such as disc brakes or electromagnetic dynamic brakes might also be used to resist rotation of the cranks 14 and 18.

Referring now also to FIGS. 2 and 3, a pair of push-button operated, normally-open, momentary closure switches 66 and 68 are mounted on the crank handle 24 in a position to be pushed conveniently by the thumb of a person exercising using the exercise apparatus 10, without loosening a grasp on the handle 22. A pair of slip rings 70 and 72 are provided on an eccentric shaft 74 of the hand crank 18 on which the crank handle 24 is rotatably mounted. A brush 76 connects the switch 66 to the slip ring 72, and a brush 78 connects the switch 68 to the slip ring 72. A brush 80 connects the common voltage side of each of the switches 66 and 68 to the slip ring 70, which is connected electrically with the hand crank 18, assuming that the hand crank 18 is of a conductive material. An insulated conductor 82 electrically connects the slip ring 72 with a slip ring 84, both of the slip rings 72 and 84 being electrically insulated from the hand crank 18. A brush 86 provides an electrical connection between the slip ring 84 and a conductor 88 connected to a terminal 90 of the control unit 46. A slip ring 92 mounted on the central shaft 85 of the hand crank 18 is connected electrically with the control unit through a brush 94 connected electrically with a terminal 96 of the control unit 46.

Alternatively, additional slip rings and brushes could be provided and duplicates of the switches 66 and 68 could be provided on the crank handle 22, or one of the switches 66 and 68 could be located on each of the crank handles 22 and 24, although the preferred embodiment is described above.

A diode 98 is connected in series between the brush 76 and the switch 66, while a diode 100 is connected in opposite polarity between the brush set 78 and the switch 68. An alternating voltage is provided at terminal 90 of the control unit 46, but the diodes 98 and 100, respectively, make only pulsating direct current voltage available, with opposite polarities, across the switches 66 and 68. Closing the switch 66 thus provides a complete circuit as to current in one direction through the conductor 88 and back to the control unit 46 at terminal 96, while closure of the switch 68 permits passage of current in the opposite direction. The microprocessor 48 is programmed appropriately so that current in the first direction, passed when switch 66 is closed, provides an enabling signal to a motor controller 102 connected electrically to the tension adjuster 42, to increase the amount of tension in the brake band 36. Conversely, closure of the switch 68, providing an electrical current in the opposite direction to the control unit 46, produces a response from the microprocessor 48 enabling the motor controller 102 so as to cause the tension adjuster 42 to reduce the tension in the brake band 36.

Preferably, the microprocessor 48 is programmed to require either the switch 66 or the switch 68 to be pressed for a predetermined amount of time before the motor controller 102 will cause an adjustment in the tension in the brake band 36, so that undesired change of the tension in the brake band 36 will not occur in response to electronic noise or inadvertent closure of one of the switches 66 and 68 independently.

When both of the switches 66 and 68 are closed simultaneously, a circuit is provided for the alternating current from terminal 90 to pass in both directions through the conductor 88. The control unit microprocessor is programmed not to adjust the tension in the brake band 36 in response to AC current.

A display panel 104 is connected electrically to the control unit 46 by a multi-conductor cable 106. The display panel 104 includes display devices, for example liquid crystal display units, capable of displaying dot-matrix numerical and alphabetical characters. A multi-digit display field 108 is provided to indicate the total force required to rotate the flywheel 12 against the resistance provided by the frictional contact between the brake band 36 and the flywheel 12. The microprocessor 48 may be appropriately programmed to provide an indication of force in some arbitrary scale of units bearing a linear relationship to the amount of frictional resistance provided by the brake band 36, as calculated by the microprocessor 48.

A multi-digit time display field 110 is provided to indicate the amount of time during which exercise has been conducted, once the entire apparatus 10 has been electrically energized. A third numerical display field 112 is used to provide indications of various values computed by the microprocessor 48 in response to inputs to the control unit 46 from various sensors. The descriptive name of each value shown in the numerical display field 112 is shown in a similar electronically generated alphabetical title display field 114 on the display unit 104 to identify the value shown in the display field 112.

The desired individual one of the several possible values to be displayed may be chosen by simultaneously closing both of the switches 66 and 68 to provide an alternating current circuit from terminal 90 to terminal 96 of the control unit 46. The microprocessor 46 is appropriately programmed to cycle through the list of available data for display, while the appropriate values are also provided by the microprocessor 48 via the cable 106 to the display field 112, in response to the alternating current provided when both of the switches 66 and 68 are closed. Thus, it is possible to indicate and display such information as the total work performed during the exercise, or the user's heart rate (made available as an input to the microprocessor 48 by a heart rate sensor 118 of a known type capable of providing an electrical output signal). Similarly, the information available from the strain gauge 45, the speed indicating pulse generator 58, and the force detector 56, together with a time signal generated internally by the microprocessor 48, may be used to calculate speed, distance, arm output, and leg output data for display in the display field 112.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An exercise device providing variable resistance to the efforts of a person using the device, comprising:

(a) a hand crank mounted for rotation by the person using the device;

(b) a load connected with said hand crank so as to be drivable by rotation of the hand crank;

(c) resistance means connected with said load and controllable for varying the resistance to the effort required to drive said load;

(d) control means responsive to an electrical signal directed thereto for controlling said resistance means; and (e) switch means mounted on said hand crank operably within reach of a digit of a hand of a person using the exercise device, the switch means being operable by the digit while said hand continues to be used to rotate said hand crank, the switch means being operable for directing said electrical signal to said control means.

2. An exercise device providing variable resistance to the efforts of a person using the device, comprising:

(a) an exercise load;

(b) a hand crank including a handle, said hand crank being mounted rotatably and said handle being mounted pivotably on said hand crank;

(c) connecting means for driving said load in response to rotation of said hand crank;

(d) variable resistance means associated with said load for providing resistance to rotation of said hand crank;

(e) electrically controllable adjusting means for varying the amount of resistance provided by said variable resistance means;

(f) control switch means mounted on said handle for controlling said electrically controllable adjusting means electrically; and (g) a rotatable pedal crank and pedal drive means for connecting said pedal crank drivingly to said load independently of said connecting means so that rotation of said hand crank does not result in rotation of said pedal crank.

3. The device of claim 2 including speed sensor means associated with said load for detecting the speed at which said load is being moved by a person using the device, and display means connected electrically with said speed sensor means for displaying a visible indication of the speed measured by said speed sensor means.

4. The device of claim 2 in which said load includes a flywheel and said variable resistance means includes a brake band located in frictional contact with said flywheel and wherein said electrically controllable adjusting means includes means for applying a variable amount of tension to said brake band in order to provide controlled variation of frictional resistance to rotation of said flywheel.

5. The exercise device of claim 4 including resistance sensor means associated with said brake band for determining the amount of frictional resistance provided by said variable resistance means.

6. The exercise device of claim 2 including resistance sensor means associated with said variable resistance means for sensing the amount of resistance provided by said variable resistance means, and display means for providing an indication thereof to a person using said device.

7. The exercise device of claim 2 including force sensor means associated with said connecting means for sensing the amount of force applied to said load through said connecting means and for providing an indication thereof to said user of said device.

8. The exercise device of claim 2 wherein said load includes a flywheel and said variable resistance means includes a brake band arranged to provide frictional resistance to rotation of said flywheel and wherein said electrically controllable adjusting means includes means for applying a variable amount of tension to said brake band in order to vary the amount of frictional resistance to rotation of said flywheel, said exercise device further including resistance sensor means associated with said brake band for determining the amount of resistance provided by said variable resistance means, force sensor means associated with said connecting means for sensing the amount of force applied to said load through said connecting means, display means responsive to said force sensor means for providing an indication of the amount of force applied to said load through said connecting means to said user of said device, a pedal crank and pedal drive means connecting said pedal crank drivingly to said load, and means for separately indicating the amount of force applied to said load by said pedal crank.

9. An exercise machine, comprising:

(a) a supporting frame;

(b) a movable hand crank mounted to the frame, the hand crank carrying a handle configured for grasping by the hand of a person using the machine;

(c) resistance means connected to said hand crank for resisting movement of said hand crank;

(d) adjusting means operable for adjusting the degree to which said resistance means resists movement of the hand crank;

(e) a control circuit extending between the adjusting means and the handle and actuatable to provide a signal for operating the adjusting means; and (f) at least one switch mounted on the handle within reach of a digit of the hand of the person using the machine while the person grasps the handle, the switch being connected to the circuit and operable for actuating the circuit.

10. The exercise device of claim 2 including a control unit, said control unit including an AC voltage source, said control switch means including a pair of switches located in close proximity to each other on said hand crank handle, said switches being connected in parallel between said AC voltage source and said control unit, and each switch of said pair being connected in series with a respective diode, said diodes being connected in opposing polarity, so that closure of a first one of said pair of switches completes a circuit path in a first direction with respect to said control unit and closure of the other of said pair of switches completes a circuit path in the opposite direction with respect to said control unit.

11. The device of claim 10 wherein said switches are connected with said control unit electrically through a plurality of slip rings located on said hand crank and respective brushes mounted in said crank handle switches.

12. The device of claim 10, including a pair of slip rings located adjacent said handle on an eccentric shaft portion of said hand crank, said slip rings being electrically insulated from each other, and each of said control switches being electrically connected between respective brushes electrically in contact with said slip rings, and said AC voltage source of said control unit being electrically connected with one of said slip rings.

13. The exercise machine of claim 9 wherein a pair of switches is mounted on the handle means and wherein a first one of said pair of switches is connected so as to increase the amount of resistance provided by said variable resistance means and a second one of said switches is connected so as to decrease the amount of resistance provided by said variable resistance means.

14. The device of claim 1 wherein the resistance means, the control means, and the switch means are operatively associated for gradually varying the amount of resistance to the effort required to drive said load.

15. The device of claim 2 wherein the electrically controllable adjusting means are controllable for gradually varying the amount of resistance provided by the variable resistance means.

16. The device of claim 13 wherein the adjusting means, the control circuit, and the switch are operatively associated to permit gradual adjustment of the degree to which said resistance means resists movement of the hand crank.

* * * * *